United States Patent [19]

Hanna et al.

[11] Patent Number: 4,949,877

[45] Date of Patent: Aug. 21, 1990

[54] FLUID DISPENSER VALVE

[75] Inventors: Emmanuel A. Hanna, Lakeview Terrace; Henry J. Loewenthal, Santa Monica, both of Calif.

[73] Assignee: Bobrick Washroom Equipment, Inc., North Hollywood, Calif.

[21] Appl. No.: 350,650

[22] Filed: May 11, 1989

[51] Int. Cl.[5] ..... B65D 88/54

[52] U.S. Cl. ..... 222/341; 222/383; 222/185

[58] Field of Search ..... 222/383, 341, 340, 321, 222/181, 185, 409, 522, 378; 417/559, 567

[56] References Cited

U.S. PATENT DOCUMENTS

| | | | |
|---|---|---|---|
| 2,622,539 | 12/1952 | Martin | 222/341 |
| 3,142,415 | 7/1964 | Louchheim | 222/383 |
| 3,799,448 | 3/1974 | Nozawa et al. | 222/321 |
| 4,243,159 | 1/1981 | Spatz | 222/321 |
| 4,474,307 | 10/1984 | Chappell | 222/383 |

OTHER PUBLICATIONS

Bobrick Drawings 111-111, 111-113, 111-119, 111-189.
Bobrick Drawings B-113, 113-10, 113-11, 113-79

*Primary Examiner*—H. Grant Skaggs
*Assistant Examiner*—Kenneth Noland
*Attorney, Agent, or Firm*—Harris, Kern, Wallen & Tinsley

[57] ABSTRACT

A fluid dispenser having a fluid storage container and a plunger carried in the container, with the plunger being manually pushable inward for dispensing fluid from the container. The container includes a valve cylinder mounted in the container and having an inner opening and an interior passage for slidingly receiving the plunger, with the plunger having a fluid flow passage therein providing a flow path from the cylinder interior to the exterior of the dispenser. A one-way capsule valve is positioned for control of the fluid flow into the cylinder interior and another one-way valve is disposed for control of the fluid flow from the cylinder interior into the plunger passage. The capsule valve comprises a disk assembly of a relatively rigid washer with a central opening, and a relatively flexible resilient seal having an annular rim enclosing the washer and a central flapper joined to the rim and overlying the washer central opening.

10 Claims, 4 Drawing Sheets

FLUID DISPENSER VALVE

BACKGROUND OF THE INVENTION

This invention relates to fluid dispensers, and in particular to a new and improved push-in type dispenser incorporating a one-way capsule valve for controlling flow between the container and the cylinder-plunger assembly. The dispenser is particularly suited for handling both viscus and nonviscus liquids. The presently preferred embodiment of the dispenser has been operated satisfactorily with free-flowing liquids and lotions having viscosities in excess of 5,000 cps.

Containers with horizontally oriented plungers for pump type dispensing of fluid from the container are known and have been used for some time. A typical conventional dispenser of this type has a cylinder with a plunger slidingly positioned therein, a first one-way valve for controlling flow from the container into the cylinder, and a second one-way valve for controlling flow from the cylinder through a flow path in the plunger to the exterior of the container. Dispensers of this type utilized an umbrella type valve as the first one-way valve and a flapper type valve as the second one-way valve. Containers with vertically oriented plungers also are known and have been used for some time. Dispensers of this type are disclosed and discussed in applicants copending application U.S. Ser. No. 07/232,679 filed Aug. 16, 1988 and reference may be had to that application for additional background information.

The umbrella valve is satisfactory in many situations. However such a valve is relatively expensive to produce, and problems have been encountered when the valve is used with high head pressures. Under such conditions valve operation is disturbed by the presence of foreign objects, such as dirt and hair, and very close control in the manufacturing process is required to produce consistently satisfactory umbrella valves.

SUMMARY OF THE INVENTION

It is an object of the present invention to provide a new and improved push-in fluid dispenser which overcomes the problems of the prior devices. A particular object is to provide such a fluid dispenser which incorporates a one-way head holding capsule valve in a push-in fluid dispenser, which capsule valve is more efficient and less expensive than previously used one-way valves. Use of the valve of the present invention results in a non-marginal design and an ability to hold higher levels of liquids, greater reliability with more positive shut-off and elimination of leakage, a lower cost unit, and a greater tolerance to variations in component thickness and/or hardness and to the presence of dirt, debris and impurities.

The new and improved fluid dispenser includes a fluid storage container and a plunger carried in a valve cylinder mounted on the container. The plunger slides in the cylinder and has a fluid flow passage providing a flow path from the interior of the cylinder to the exterior of the dispenser. A first one-way capsule valve is positioned at the inner opening at the cylinder for fluid flow from the container to the interior of the cylinder. A second one-way valve is positioned in the plunger for controlling fluid flow from the interior of the cylinder to the exterior of the dispenser.

The one-way capsule valve is a disc assembly of a relatively rigid washer with a central opening and a relatively flexible resilient seal having an annular rim enclosing the washer and a central flapper joined to the rim and overlying the washer opening. The resilient annular rim also provides a fluid seal with the cylinder wall.

The above recited and other objects, advantages features and results of the invention will more fully appear in the course of the following description.

DESCRIPTION OF THE PREFERRED EMBODIMENTS

Figure 1:
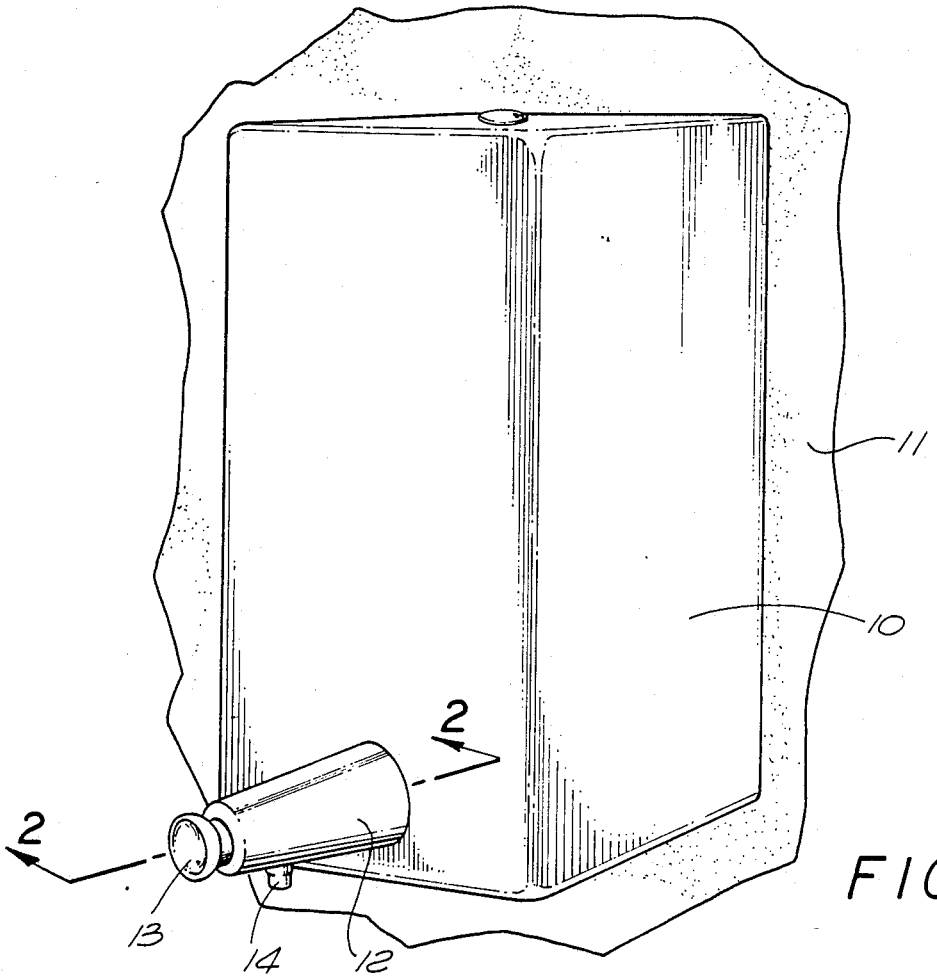
FIG. 1 is a perspective view of a fluid dispenser mounted on a wall and incorporating the presently preferred embodiment of the invention.

In FIG. 1 a dispenser container 10 is shown mounted on a wall 11. A valve cylinder 12 is mounted on the container, with a plunger 13 and an outlet nozzle 14 also shown in FIG. 1.

Figure 2:
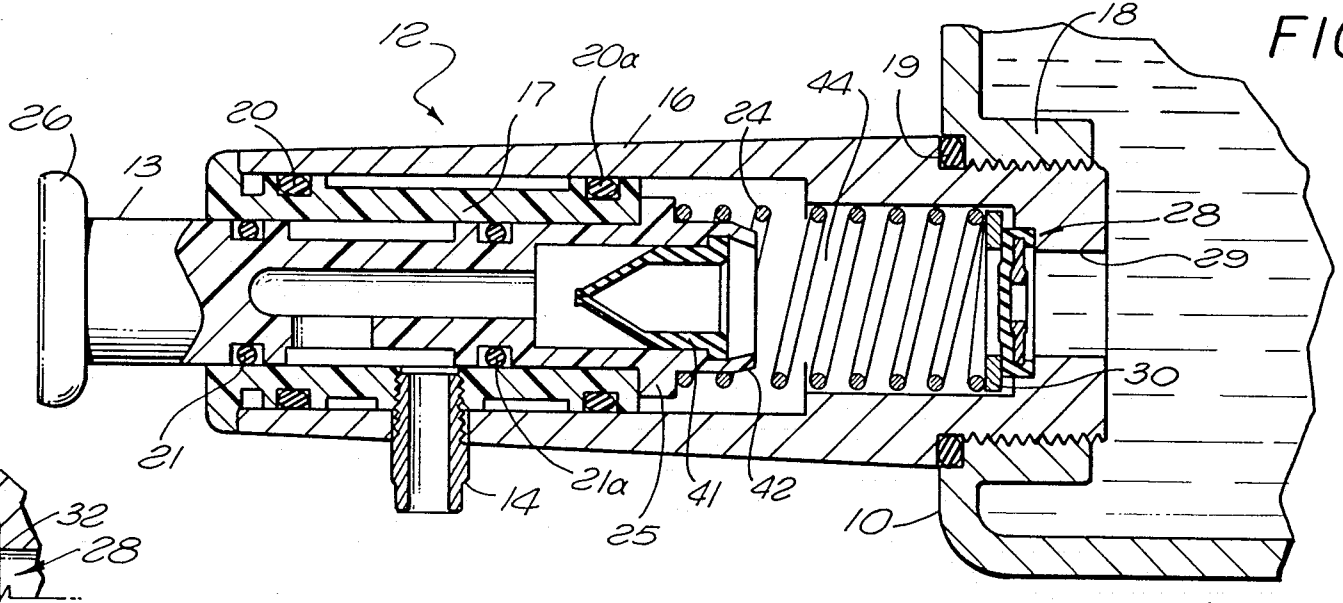
FIG. 2 is an enlarged partial sectional view taken along the line 2—2 of FIG. 1 with the plunger in the outward or rest position.

Turning to FIG. 2, the valve cylinder 12 includes an outer sleeve 16 and inner sleeve 17, with the plunger 13 sliding in the inner sleeve 17, with the plunger 13 sliding in the inner sleeve. The outer sleeve 16 is threadly mounted in a boss 18 of the container 10, with an O ring seal 19 positioned between the components. The inner sleeve 17 slides into the outer sleeve 16 and incorporates O ring sliding seals 20, **20*a* between the inner and outer sleeves. In the embodiment illustrated, the outlet nozzle 14** also serves to hold in the inner and outer sleeves in position, with the nozzle passing through an opening in the outer sleeve and being threaded into a mating threaded opening of the inner sleeve.

The plunger 13 slides in the inner sleeve 17 and incorporates O ring sliding seals 21, **21*a*. The plunger is urged outward or to the left as viewed in FIG. 2, by a coil spring 24, with a shoulder 25 on the plunger acting as a stop for limiting outward movement of the plunger. A cap 26 may be positioned on the outer end of the plunger 13** if desired, to provide a larger area for manual engagement with the plunger and for limiting inward movement of the plunger.

A one-way valve 28 is positioned at a shoulder at an inner end 29 of the sleeve 16. The spring 24 serves to hold the valve 28 in position against the shoulder, preferably with a washer 30 positioned between the spring and the valve.

Figure 4:
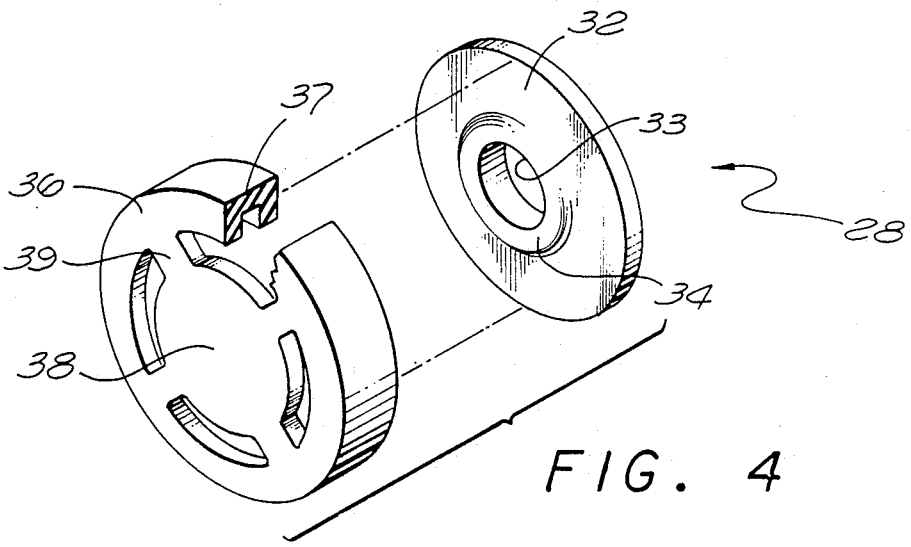
FIG. 4 is an enlarged exploded view showing the capsule valve.
Figure 3:
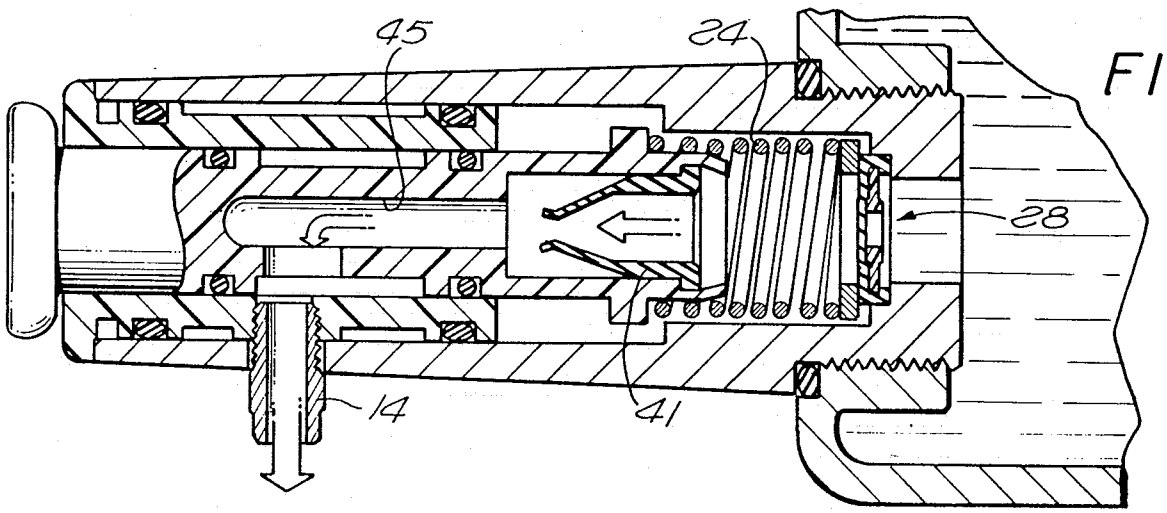
FIG. 3 is a view similar to that of FIG. 2 with the plunger in the inward or discharge position.

The one-way valve 28, also known as a capsule valve, is shown in greater detail in FIG. 4. A relatively rigid washer 32, typically of metal or rigid plastic, has a central opening 33, and preferably has a projecting annular shoulder 34 at the central opening. Ordinarily, shoulders 34 are provided at each face of the washer, as seen in FIGS. 2 and 3, so that orientation of the washer during assembly is not a concern. A relatively flexible resilient seal 36 has an annular rim 37 and a central flapper 38. The annular rim functions to position the seal on the washer, as shown in FIGS. 2 and 3, and to provide a fluid seal with the valve cylinder 12. The flapper 38 is joined to the rim 37 by ribs 39.

Figure 3A:
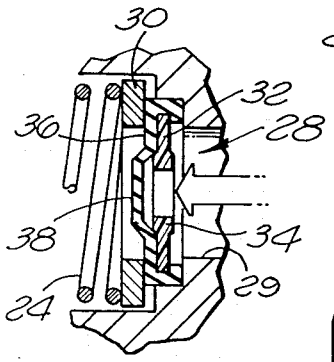
FIG. 3A is a partial view similar to that of FIG. 3 showing the one-way capsule valve operation during the movement of the plunger from the position of FIG. 3 to the position of FIG. 2.

When the capsule valve is at rest, as shown in FIG. 2, the flapper engages the shoulder and the valve is closed. When the differential pressure across the flapper exceed a predetermined amount determined by the construction of the specific valve utilized, the flapper is moved away from the shoulder, as shown in FIG. 3A, and the valve is open, permitting flow from the right to the left as seen in the drawing figures, that is from the container 10 to the interior of the valve cylinder 12. The pressure at which the capsule valve opens for flow can be altered by changing the hardness and/or thickness of the material of the valve seal 36 and/or the height of the shoulder 34 of the washer 32.

The stretched condition of the seal 36 when installed on the washer 32 urges the flapper 38 against the shoulder 34 so that the valve is preloaded in the closed position. For most uses, the pressure differential required to open the valve and permit flow therethrough is in the order of 2 to 4 times the pressure of the head of the liquid in the container.

Another one-way valve 41 is positioned in the inner end of the plunger 13, which inner end is partially closed by an inturned flange 42. The valve 41 may be a conventional duck bill valve, typically molded of a resilient elastomeric material, which can be compressed and inserted through the flange 42.

In operation, the dispenser is shown in the normal or rest position in FIG. 2. Both valves 28 and 41 are closed and there is a quantity of the fluid of the container in the interior space 44 of the valve cylinder. Fluid is dispensed by pushing the plunger inward to the position of FIG. 3. The spring 24 is compressed and the volume of the space 44 is reduced. The increase in pressure on the fluid within the cylinder forces the valve 41 open and fluid flows from the space 44, through the valve 41 and the interior passage 45 of the plunger, and out through the nozzle 14. During this operation, the one-way valve 28 remains closed.

When the manual pressure on the plunger is release, the spring 24 moves the plunger from the discharge position of FIG. 3 toward the rest position of FIG. 2. The flapper valve 41 closes and the differential pressure across the valve 28 is reduced. Then the pressure of the fluid in the container 10 causes the flapper 38 of the capsule valve 28 to move to the left away from the sholder 34, permitting fluid flow through the valve into the chamber interior 44, as illustrated in FIG. 3A. Flow continues through the valve 28 until the differential pressure increases to the value at which the resilent nature of the seal moves the flapper into engagement with the shoulder, closing the valve. The dispenser is now in the condition of FIG. 2, with a charge of fluid in the cylinder space 44, ready for another dispensing operation.

Features and advantages of the present design include:

Greater efficiency in its ability to hold higher heads.

Greater reliability. Foreign objects such as dirt and hair do not get stuck under the valve, keeping it open.

Greater forgiveness with regard to tolerances of elastic valve seal hardness and dimensions.

Economy. Lower cost than umbrella valve and valve seal combination which also requires an elastic sealing washer.

Figure 5:
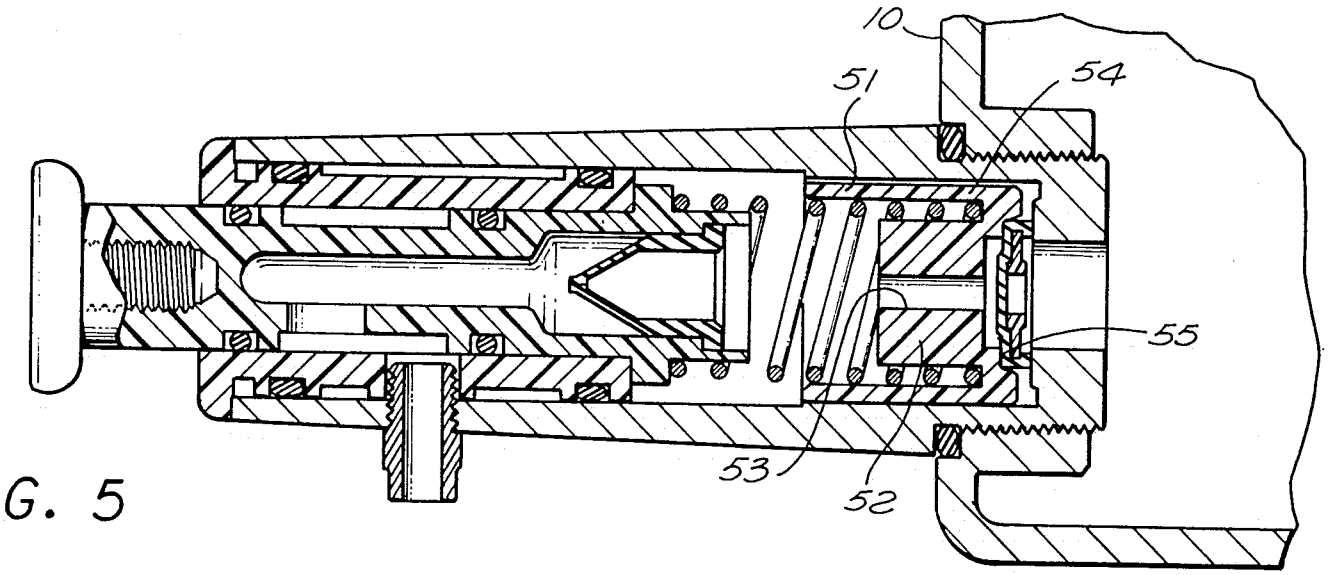
FIG. 5 is a view similar to that of FIG. 2 showing an alternative embodiment with a spring housing.

An alternative embodiment of the dispenser incorporating a spring housing 51 is shown in FIG. 5. Components corresponding to those of FIGS. 1–4 are identified by the same reference numerals. The spring housing 51, typically a plastic molding, includes a core 52 with a passage 53 therethrough, and a sleeve 54 which cooperates with the core to define an annular opening for seating the spring 44. A recess 55 is incorporated in the spring housing for retaining and locating the capsule valve.

Figure 6:
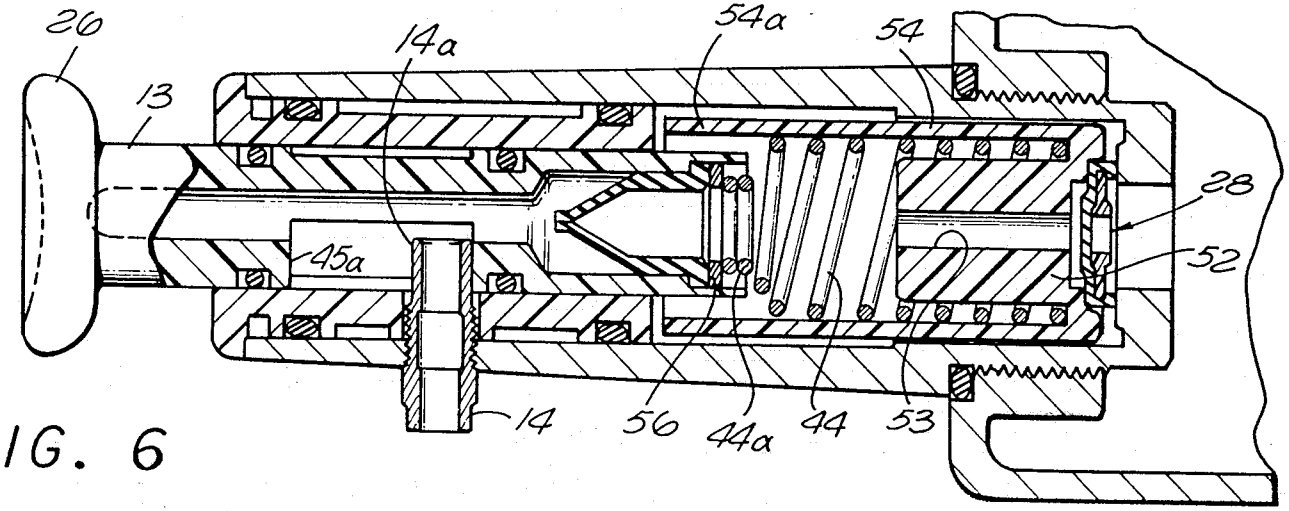
FIG. 6 is a view similar to that of FIGS. 2 and 5 showing another alternative embodiment with a one piece plunger.

Another alternative embodiment is shown in FIG. 6, with cap 26 formed as a single piece with the plunger 13. In this embodiment, the outlet nozzle 14 has an inner end **14*a* which projects into a lateral section 45*a*** of the interior passage of the plunger to serve as a stop for limiting outward movement of the plunger. The plunger itself is designed to be inserted into the cylinder from the outer end of the cylinder in this embodiment. This is in contrast to the earlier disclosed embodiments, where the plunger is inserted into the cylinder from the inner end of the cylinder prior to attaching the cap to the outer end of the plunger.

Also in this embodiment, the spring 44 has a reduced section **44*a* which rests against a washer 56 between the spring and the valve 41, holding the valve in place in the plunger. Also, the sleeve 54 of the spring housing 51 has an extension 54*a*** which encloses the entire spring.

Figure 7:
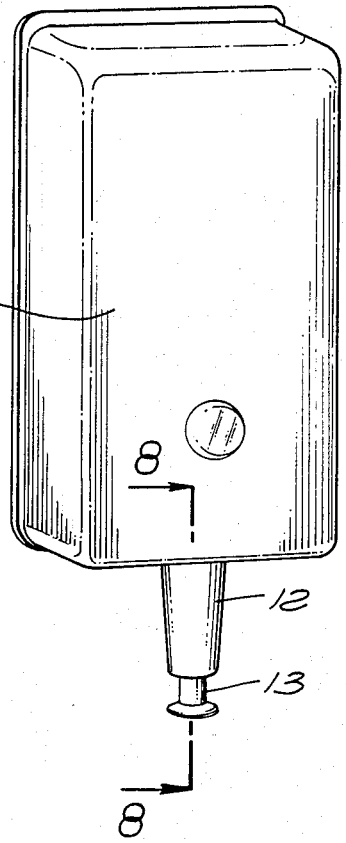
FIG. 7 is a view similar to that of FIG. 1 showing a vertically oriented dispenser.
Figure 8:
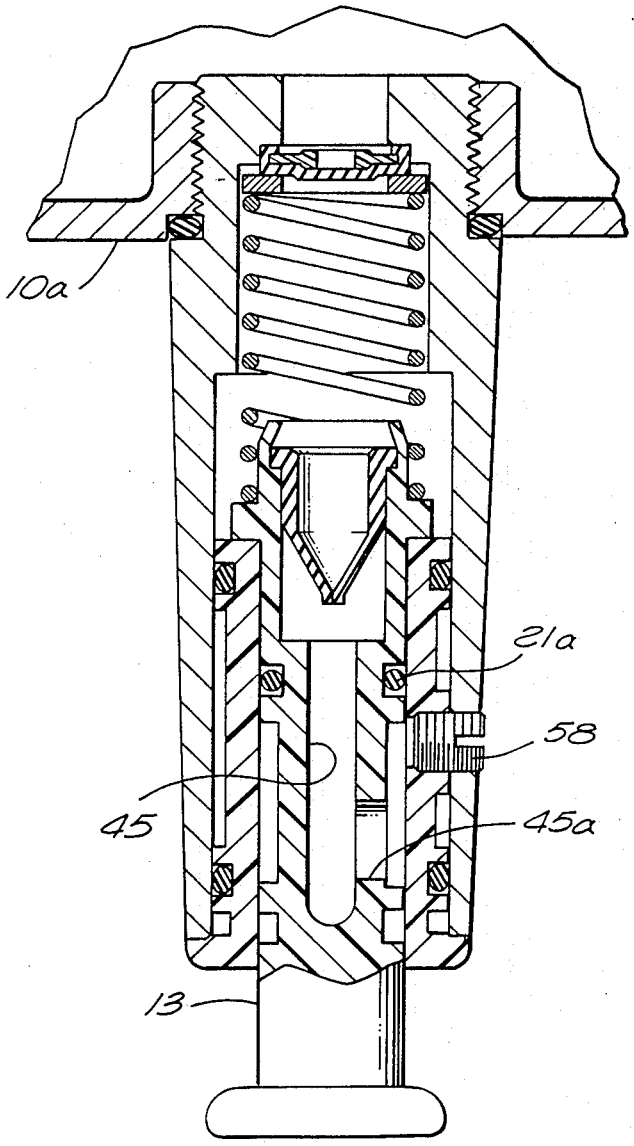
FIG. 8 is an enlarged partial sectional view taken along the line 8—8 of FIG. 7.

Another alternative embodiment is shown in FIGS. 7 and 8, with the dispenser oriented vertically. The valve cylinder 12 is mounted at the bottom of a dispenser container **10*a*. A plug 58 is used in place of the outlet nozzle 14, and the O ring 21 is omitted. The flow path is through the axial passage 45 of the plunger, the lateral passage 45*a*, and down between the plunger and the cylinder. With this design, the dispenser of any of the previous embodiments can be utilized in a vertical orientation by merely substituting the plug for the outlet nozzle and omitting the O ring. Alternatively, a dispenser as shown in FIGS. 7 and 8** can be produced for vertical operation only, with no opening in the cylinder for the plug and no groove in the plunger for the O ring. The clearance between the plunger and the cylinder will be one of the factors affecting the rate of flow of fluid in this embodiment.

We claim:

1. In a push-in flush dispenser having a fluid storage container and a plunger carried in said container, with said plunger being manually pushable inward for dispensing fluid from said container, the improvement comprising in combination:

a valve cylinder including means for mounting said cylinder in said container, said cylinder having an inner opening and an outer sleeve mounted in said container and an inner sleever slidably inserted into said outer sleeve, with said plunger sliding in said inner sleeve, and an outlet nozzle joining said inner and outer sleeves and forming the outlet portion of said flow path, with said plunger having a fluid flow passage therein providing a flow path from the interior of said cylinder to the exterior of said plunger within said inner sleeve and through said outlet nozzle to the exterior of said dispenser and having an outer end for engagement by an operator;

first and second one-way valves, with said first one-way valve disposed for control of fluid flow into said interior of said cylinder through said inner opening and with said second one-way valve disposed for control of fluid flow from said interior into said plunger passage, said first one-way valve comprising a disc assembly of a relatively rigid washer with a central opening, and a relatively flexible resilient seal having an annular rim enclosing said washer and a central flapper joined to said rim and overlying said washer central opening;

spring means engaging said cylinder and plunger for urging said plunger outward away from said cylinder inner opening; and interengaging stop means in said cylinder and plunger for limiting outward movement of said plunger and with engagement of said plunger with said cylinder limiting inward movement of said plunger;

said plunger and said inner sleeve having spaced first and second interengaging seal means for axial sliding of said plunger in said inner sleeve, with said seal means positioned to provide sealing between said plunger and inner sleeve around said flow path on said exterior of said plunger for the entire movement of said plunger between the outward and inward limited positions;

with an inward force on said plunger moving said plunger inward compressing said spring means and forcing fluid from said interior of said cylinder out said plunger passage through said second one-way valve, and with said spring means moving said plunger outward drawing fluid from said container into said interior of said cylinder through said inner opening and first one-way valve.

2. A dispenser as defined in claim 1 wherein said valve cylinder includes a recess around said inner opening with said first one-way valve positioned in said recess, and including a washer positioned between said first valve and said spring means.

3. A dispenser as defined in claim 1 including a spring housing in said valve cylinder between said inner opening and said plunger, said spring housing having a core with an axial passage therethrough, and an annular chamber around said core with said spring means positioned in said annular chamber.

4. In a push-in fluid dispenser having a fluid storage container and a plunger carried in said container, with said plunger being manually pushable inward for dispensing fluid from said container, the improvement comprising in combination:

a valve cylinder including means for mounting said cylinder in said container, said cylinder having an inner opening and an interior passage for slidingly receiving said plunger, with said plunger having a fluid flow passage therein providing a flow path from the interior of said cylinder to the exterior of said dispenser and having an outer end for engagement by an operator;

first and second one-way valves, with said first one-way valve disposed for control of fluid flow into said interior of said cylinder through said inner opening and with said second one-way valve disposed for control of fluid flow from said interior into said plunger passage, said first one-way valve comprising a disc assembly of a relatively rigid washer with a central opening, and a relatively flexible resilient seal having an annular rim enclosing said washer and a central flapper joined to said rim and overlying said washer central opening;

spring means engaging said cylinder and plunger for urging said plunger outward away from said cylinder inner opening; and interengaging stop means in said cylinder and plunger for limiting outward movement of said plunger;

with an inward force on said plunger moving said plunger inward compressing said spring means and forcing fluid from said interior of said cylinder out said plunger passage through said second one-way valve, and with said spring means moving said plunger outward drawing fluid from said container into said interior of said cylinder through said inner opening and first one-way valve, said first one-way valve being a self-contained head holding valve with said washer having a projecting annular shoulder at said central opening, with said flapper engaging said shoulder.

5. A dispenser as defined in claim 4 wherein said second one way valve comprises a flexible duck bill valve positioned within said plunger passage.

6. A dispenser as defined in claim 5 wherein said spring means is a coil spring positioned between said first and second one-way valves and urging said first one-way valve into engagement with said cylinder.

7. A dispenser as defined in claim 6 wherein said valve cylinder includes an outer sleeve mounted in said container and an inner sleeve slidably inserted into said outer sleeve, with said plunger sliding in said inner sleeve, and an outlet nozzle joining said inner and outer sleeves and forming the outlet portion of said flow path.

8. A dispenser as defined in claim 4 wherein said plunger is horizontally oriented in said container, and including first and second interengaging sliding seals between said plunger exterior and said container interior and positioned along the axis of said plunger, and an outlet nozzle carried in said valve cylinder in said fluid flow path between said first and second sliding seals.

9. A dispenser as defined in claim 4 wherein said plunger is vertically oriented in said container, and including an interengaging sliding seal between said plunger exterior and said container interior, with said plunger fluid flow passage including an upstream axial section passing said sliding seal and a downstream lateral section outboard of said sliding seal, with said flow path through said axial section, said lateral section and out between said plunger and cylinder.

10. In a push-in fluid dispenser having a fluid storage container and a vertically oriented plunger carried in said container, with said plunger being manually pushable inward for dispensing fluid from said container, the improvement comprising in combination:

a valve cylinder including means for mounting said cylinder in said container, said cylinder having an inner opening and an outer sleeve mounted in said container and an inner sleeve slidably inserted into said outer sleeve, with said plunger sliding in said inner sleeve, and an outlet nozzle joining said inner and outer sleeves and forming the outlet portion of said flow path, with said plunger having a fluid flow passage therein providing a flow path from the interior of said cylinder to the exterior of said plunger within said inner sleeve and through said outlet nozzle to the exterior of said dispenser and having an outer end for engagement by an operator;

an interengaging sliding seal between said plunger exterior and said inner sleeve interior, with said plunger fluid flow passage including an upstream axial section passing said sliding seal and a downstream lateral section outboard of said sliding seal, with said flow path through said axial section, said lateral section and out between said plunger and cylinder and with said seal positioned to provide sealing between said plunger and inner sleeve around said flow path on said exterior of said plunger for the entire movement of said plunger between outward and inward limited positions;

first and second one-way valves, with said first one-way valve disposed for control of fluid flow into said interior of said cylinder through said inner opening and with said second one-way valve disposed for control of fluid flow from said interior into said plunger passage, said first one-way valve comprising a disc assembly of a relatively rigid washer with a central opening, and a relatively flexible resilient seal having an annular rim enclosing said washer and a central flapper joined to said rim and overlying said washer central opening;

spring means engaging said cylinder and plunger for urging said plunger outward away from said cylinder inner opening; and interengaging stop means in said cylinder and plunger for limiting outward movement of said plunger and with engagement of said plunger with said cylinder limiting inward movement of said plunger;

with an inward force on said plunger moving said plunger inward compressing said spring means and forcing fluid from said interior of said cylinder out said plunger passage through said second one-way valve, and with said spring means moving said plunger outward drawing fluid from said container into said interior of said cylinder through said inner opening and first one-way valve.

* * * * *